US006129114A

United States Patent [19]

Almasio et al.

[11] Patent Number: 6,129,114

[45] Date of Patent: Oct. 10, 2000

[54] PNEUMATIC PULSE GENERATOR

[75] Inventors: Vittorio Almasio, Cernusco sul Naviglio; Sandro Ramponi, Ferrara; Lamberto Vincenzi, S. Prospero Sulla Secchia, all of Italy

[73] Assignee: IDR Holding S.A., Luxembourg, Luxembourg

[21] Appl. No.: 09/292,678

[22] Filed: Apr. 16, 1999

[30] Foreign Application Priority Data

Jul. 8, 1998 [EP] European Pat. Off. ..... 98112605

[51] Int. Cl.[7] ..... F15B 21/12

[52] U.S. Cl. ..... 137/624.14; 137/102

[58] Field of Search ..... 137/624.14, 624.13, 137/102, 106

[56] References Cited

U.S. PATENT DOCUMENTS

| | | | |
|---|---|---|---|
| 3,958,495 | 5/1976 | Bernhoft | 137/102 X |
| 4,690,166 | 9/1987 | Howeth | 137/624.14 |
| 4,922,962 | 5/1990 | Jones | 137/624.14 |
| 5,762,102 | 6/1998 | Rimboym | 137/102 X |

FOREIGN PATENT DOCUMENTS

| | | |
|---|---|---|
| 1260252 | 2/1968 | Germany . |
| 2202804 | 7/1973 | Germany . |
| 2852294 | 7/1980 | Germany . |
| 1251610 | 6/1970 | United Kingdom . |

*Primary Examiner*—Kevin Lee
*Attorney, Agent, or Firm*—Browdy and Neimark

[57] ABSTRACT

The pneumatic pulse generator comprises two cursors which are mobile internally of a chamber of a distributor body into which open an input of a pressurized gas, an output and a first conduit connected to a first compression chamber. A second conduit connects the output to a second compression chamber. Two choke devices enable the flow of pressurized gas to the two compression chambers to be regulated. The pulse generator enables a succession of square-wave pulses to be generated at the output, the pulses having a work period which is adjustable by means of one of the choke devices located on the second conduit and a pause period which is adjustable by means of one of the choke devices located on the first conduit. The generator is particularly useful for controlling a blower device for cleaning a dust filter.

8 Claims, 4 Drawing Sheets

3
27
28
18
15
20
6
19
14
9
16
6
21
20
25
24
x
x
22
1
26
6
19
4
8
2
7
12
17
13
23
6

2
3
4
5
7
8
9
10
11
12
13
14
15
16
24

PNEUMATIC PULSE GENERATOR

BACKGROUND OF THE INVENTION

Specifically, though not exclusively, the invention can be used for controlling the periodic opening of the valves in a compressed-air device for cleaning a dust filter, in which the valves are closed during normal use of the filter and are periodically opened so as to send compressed air on to the filtering surfaces of the filter itself.

In particular reference is made to a pulse generator able to receive a pneumatic signal in input and to transform this signal into an output signal constituted by a succession of pulses which can be used to pilot an apparatus. The output signal is obtained by exploiting the time necessary for a chamber supplied with a pressurised gas to reach a predetermined pressure.

Pneumatic pulse generators are known in the prior art and send in output a succession of square waves, and which are suitable for receiving compressed air at relatively high pressure (above 2 bar) in input.

Other known pulse generators use a relatively low-pressure compressed air source (lower than 2 bar) and require the use of wave amplifiers.

This last type of pulse generator is unsuitable for use in the field of industrial applications such as, for example, controlling valve opening in dust filter cleaning devices.

The main aim of the present invention is to provide a pneumatic pulse generator which can use compressed air at relatively low pressures (for example, comprised between 0.5 and 2 bar) without any need for a wave amplifier.

An advantage of the invention is that it makes available a pulse generator which can simply and immediately regulate both work time (that is, the duration of a pulse) and pause time (that is, the time comprised between two consecutive pulses).

A further advantage of the invention is that the pulse generator is extremely reliable and resilient.

A still further advantage is that the pulse generator can function effectively without return springs or other like elements which are susceptible to rapid wear and thus have to be frequently substituted.

SUMMARY OF THE INVENTION

The blower device of the invention is suitable for cleaning dust filters wherein the periodical opening of the valves is controlled by a pneumatic pulse generator which can be supplied with a gas compressed at a relatively low pressure. The blower device can advantageously be made without using a solenoid type valve.

BRIEF DESCRIPTION OF THE DRAWINGS

These aims and advantages and others besides are all attained by the invention as it is characterised in the accompanying claims.

Further characteristics and advantages of the present invention will better emerge from the detailed description that follows of a preferred but non-exclusive embodiment of the invention, illustrated purely by way of a non-limiting example in the accompanying figures of the drawings, in which.

DESCRIPTION OF THE PREFERRED EMBODIMENTS

Figure 1:
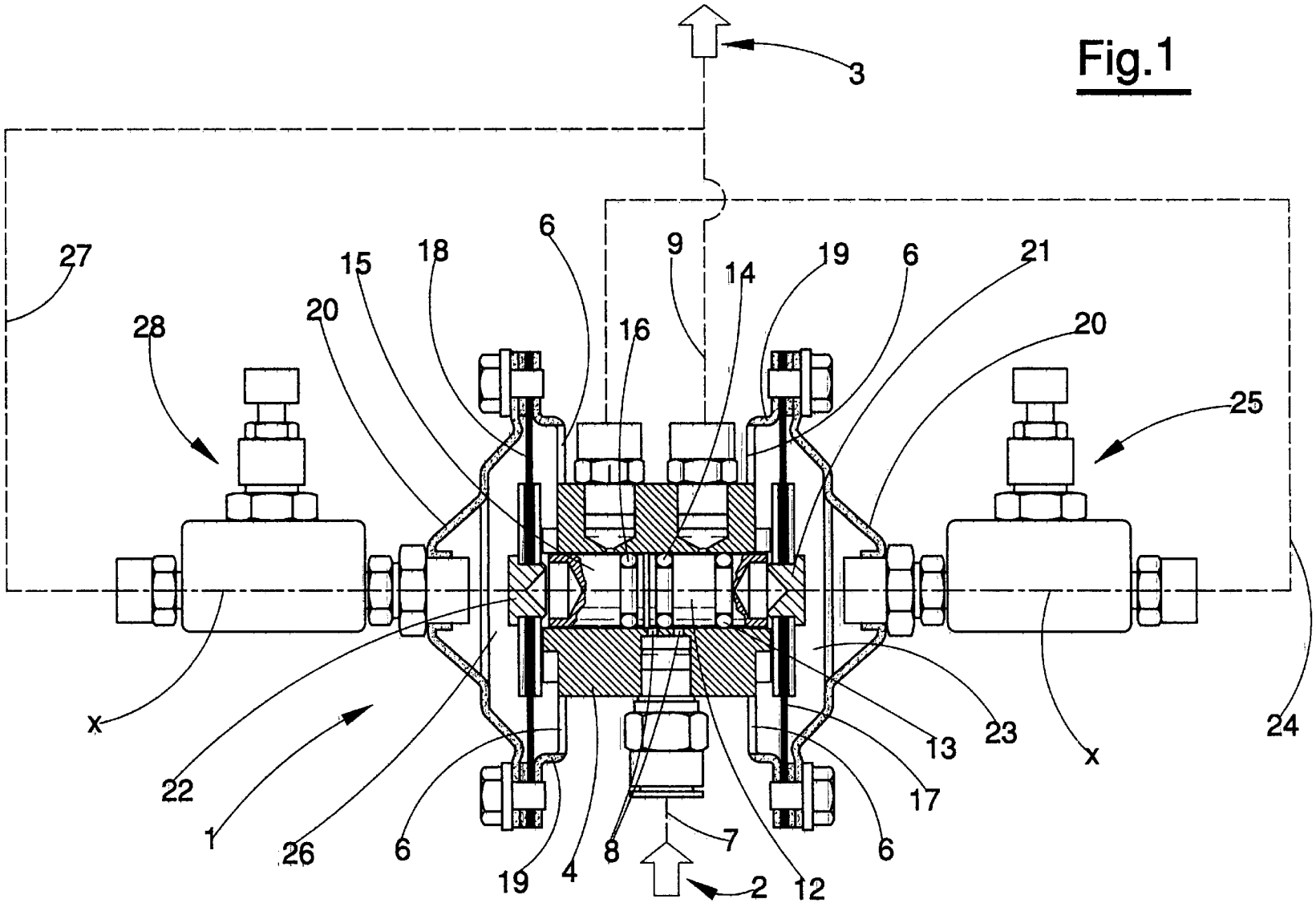
FIG. 1 is a schematic lateral view, partially sectioned, of the pulse generator of the invention.

With reference to the above-mentioned FIGS. from 1 to 2*d,* 1 denotes a pneumatic pulse generator, also known as a square wave oscillator, having an input 2 which is supplied with pressurised gas, and an output 3. The pulse generator 1 receives a pneumatic signal at the input 2 and transforms the signal into an output signal 3. The output signal is constituted by a succession of preferably square wave pulses.

The generator 1 comprises a distributor 4, internally affording a chamber 5 which extends lengthwise according to an axis x—x. The opposite ends of the chamber 5 are open and are connectable to at least one discharge 6 at atmospheric pressure. A conduit 7 connected to the input 2 opens into the chamber 5. The conduit 7 has two openings 8, set side-by-side and arranged at a short distance one from the other in the central zone of chamber 5. In FIGS. 2*a* to 2*d,* the openings 8 are represented by one for the sake of simplicity. Another conduit 9 opens into the chamber 5, which conduit 9 is connected to the output 3 and opens into the chamber 5 through an opening which is axially distanced from the openings 8, with reference to axis x—x. The chamber 5 further exhibits another opening 11 which is axially distanced from the openings 8 and is situated on the opposite side of the chamber 5 with respect to the opening 10.

A first cursor 12 is slidably arranged inside the chamber 5; the first cursor 12 is cylindrical and coaxial to the chamber 5 and at either end is provided with a ring seal 13 and 14 which achieves a seal against the internal walls of the chamber 5. The first cursor 12 is mobile in the direction of the axis x—x and can assume at least a first and a second position. In the first position FIGS. 2*a* and 2*d*) one of the two ring seals, indicated by 14, closes the connection between the first openings 8 and the second opening 10, while the other ring seal, denoted by 13, in this case does not seal as it is in a broadened portion situated at the end of the chamber 5. In this first position a connection between the second opening 10 and an open end of the chamber 5 is made possible, which open end is connected to an atmospheric-pressure discharge 6. In the second position (FIGS. 2*b* and 2*c*) the seal ring 13 is arranged in such a way as to close the connection between the second opening 10 and the discharge 6, while the connection between the first openings 8 and the second opening 10 is enabled. By effect of the pressure in the central zone of the chamber 5 connected to the pressurised gas supply 2, the first cursor 12 is pushed towards the first position (that is, towards the right in FIGS. from 2*a* to 2*d*).

A second cursor 15 is arranged in the chamber 5, which second cursor 15, like the first cursor 12, is cylindrical and coaxial to the chamber 5. An end of the second cursor 15 faces an end of the first cursor 12. The second cursor 15 exhibits a ring seal 16 which can seal against the internal walls of the chamber 5. The second cursor 15 is mobile in the chamber and can assume at least two positions. In a first position FIGS. 2*a* and 2*b*) the second cursor 15 connects the first openings 8 and the third opening 11. In this first position the ring seal 16 closes the connection between the third opening 11 and an open end of the chamber 5 (the left end in FIGS. 2*a*–2*d*), which open end is connected to a discharge 6. In a second position (FIGS. 2*c* and 2*d*) a connection is established between the third opening 11 and the discharge 6. By effect of the pressurised gas supplied to the central zone of the chamber 5 through the first openings 8, the second cursor 15 is pushed towards the first position (that is, towards the left in FIGS. 2*a*–2*d*).

Situated at the opposite ends of the distributor 4 are two elastic membranes 17 and 18, both of which are stretched by the ends between two flanged bodies 19 and 20 by means of a series of screw connections. The flanged body 19 is made solid to the distributor 4. Each membrane 17 and 18 bears a central rigid element, respectively 21 and 22, which can interact contactingly with a respective cursor 12 and 15.

The membrane 17 interacting with the first cursor 12 delimits, together with the rigid walls of a flanged body 20, a first compression chamber 23 connected through a first conduit 24 to the third opening 11. First means for regulating the flow of pressurised gas are provided for the first compression chamber 23, along the first conduit 24. These first means for regulating comprise in the present embodiment an adjustable choke located on the first conduit 24. The choke is realised by means of a device 25 comprising a regulating screw. The means for regulating operate in such a way as to achieve control over the time necessary for the first chamber 23, supplied with pressurised gas coming from the input 2 through the first conduit 24, to reach a predetermined pressure. The elastic membrane 17 is able to push the first cursor 12 from the first to the second position (that is, towards the left in FIGS. 2*a*–2*d*) by effect of a determined pressure in the first compression chamber 23. The pressure in the first chamber 23 acts on the first cursor 12 in a contrary direction to the action of the pressure present in the central zone of the chamber 5.

The membrane 18 interacting with the second cursor 15 delimits a second compression chamber 26 connected through a second conduit 27 to the second opening 10 and the output 3. Second means for regulating are provided for regulating the pressurised gas flow to the second compression chamber 26 along the second conduit 27. The second means for regulating in this case are the same as the first means for regulating and comprise a device 28 also including a regulating screw.

By effect of a predetermined pressure in the second compression chamber 26, the membrane 18 pushes the second cursor 15 in a contrary sense to the thrust direction exerted on the cursor 15 by the pressurised gas supplied through the first openings 8. In particular, the membrane 18 can push the second cursor 15 from the first to the second position (that is, rightwards with reference to FIGS. 2*a*–2*d*).

Figure 3:
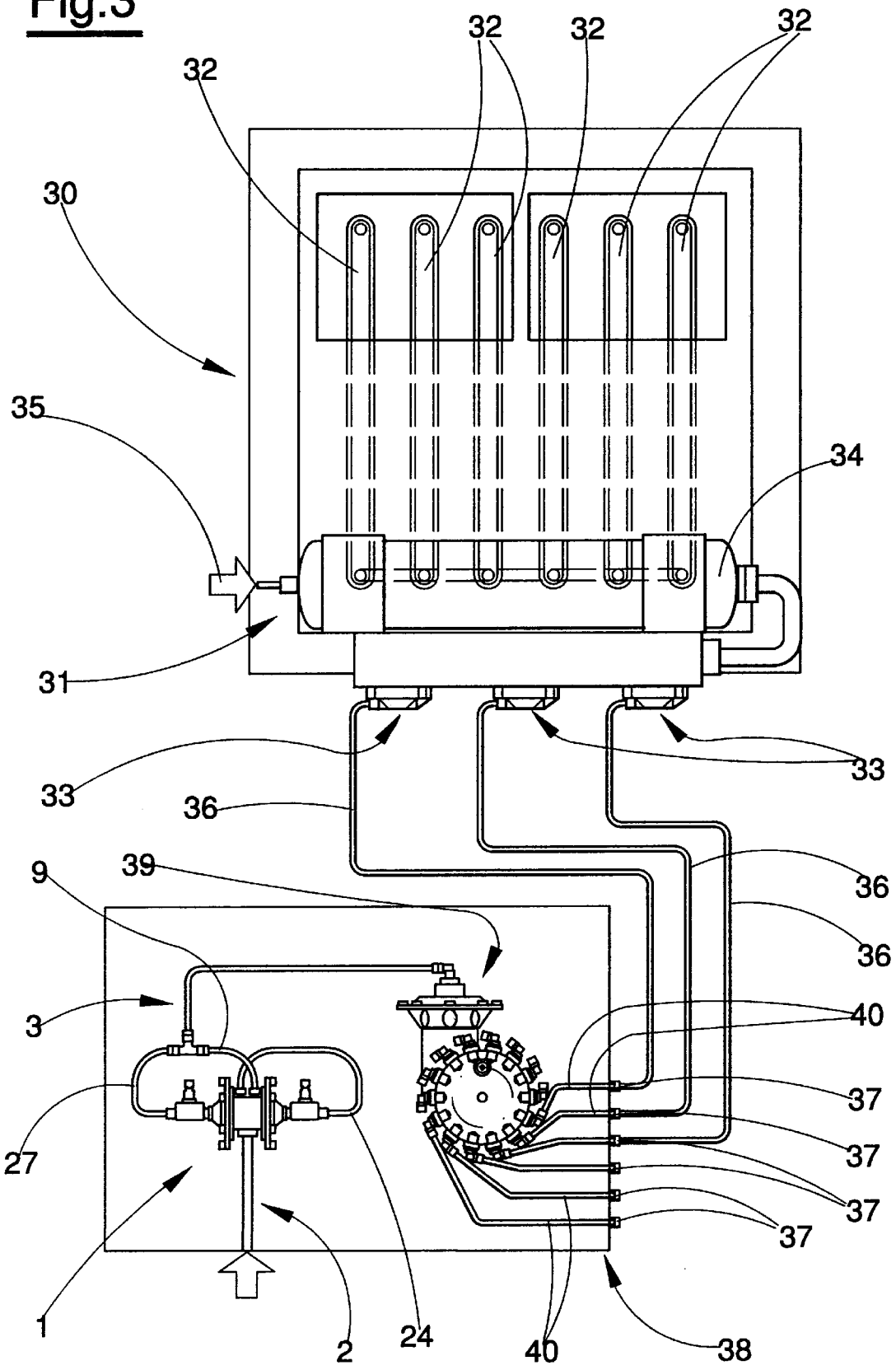
FIG. 3 is a schematic view of a blower device for cleaning a dust filter controlled by the pulse generator of FIG. 1.
Figure 5:
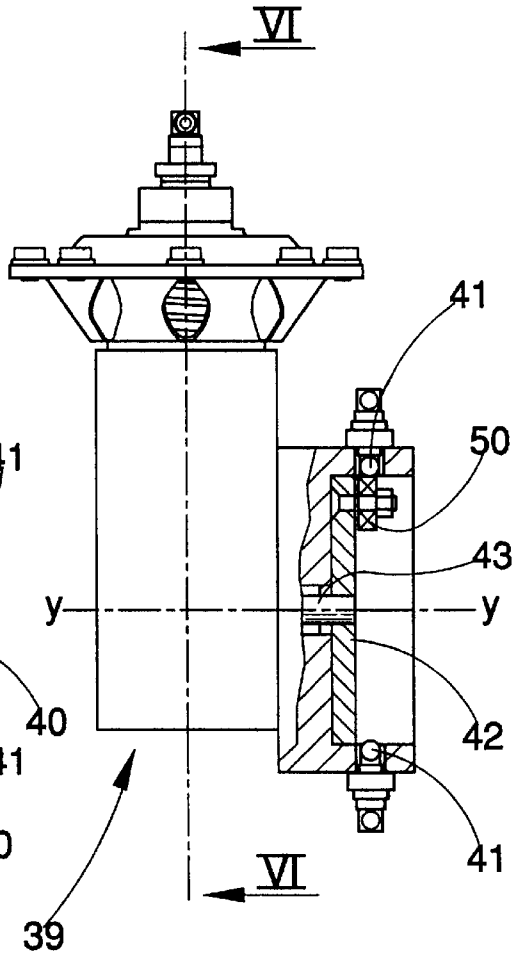
FIG. 5 shows a lateral left-side view of FIG. 4, partially sectioned according to line V—V of FIG. 4.
Figure 4:
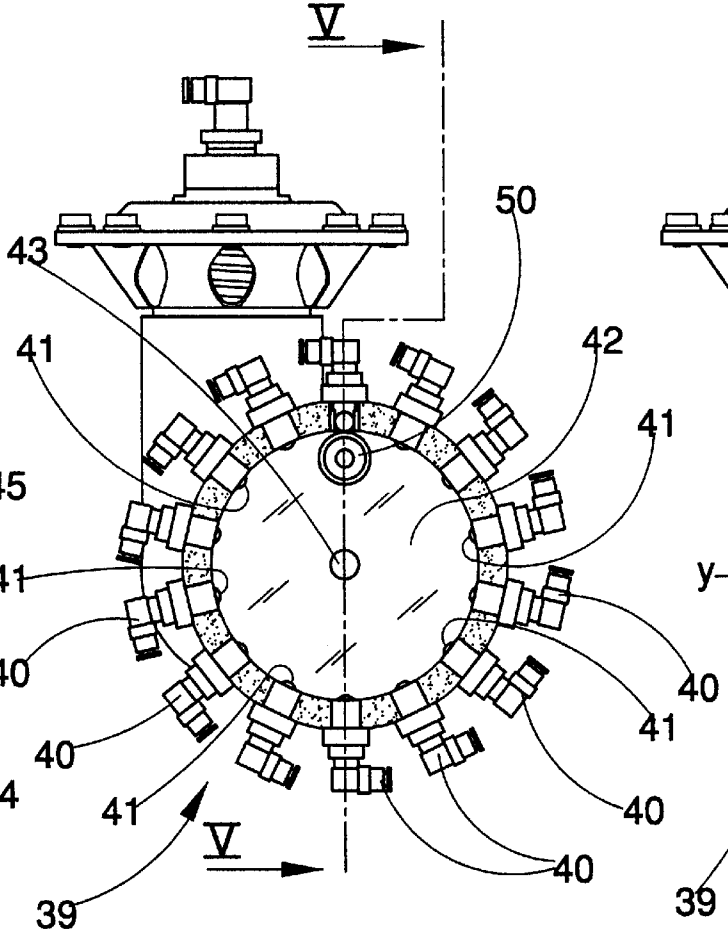
FIG. 4 shows, in enlarged scale, a detail of FIG. 3 comprising an actuator activated by the pulse generator of FIG. 1.
Figure 6:
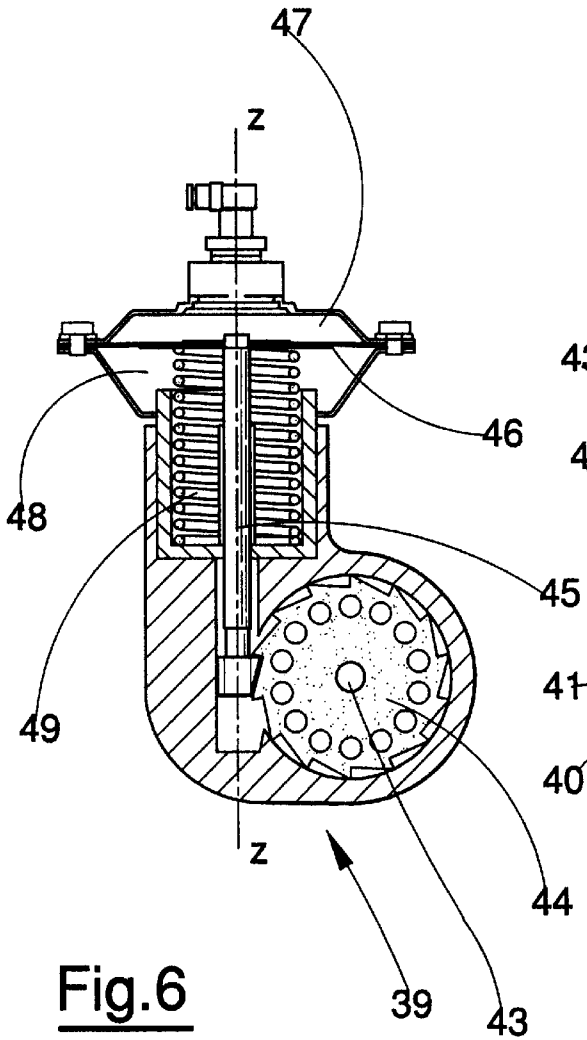
FIG. 6 is a section made according to line VI—VI of FIG. 5.

With reference to FIG. 3, 30 denotes in its entirety a dry dust filter of known type, provided with a blower cleaning device 31. The filter 30 comprises a plurality of filtering elements 32 which, in the illustrated example, are six in number and of the bag type. The walls of the bags are filtering surfaces. The filter 30 is further provided with a suction device, of known type and not illustrated, through which the purified air passes after having passed through to filtering surfaces. The filtering elements 32 are situated in a chamber provided with an opening through which the polluted air enters from the outside. In passing through the filtering walls the grains of powder suspended in the air are halted and deposited on the walls. The walls therefore have to be periodically cleaned to free them of the dust granules, thus providing good constant filtering ability.

The cleaning device 31 comprises a compressed air source destined to act on the filtering surfaces through valves 33 which in the normal use of the filter 30 are periodically closed and opened to send compressed air on to the filtering surfaces. The pressurised air detaches the dust granules from the filtering surfaces. The pressurised air source in the example comes from a tank 34 which is kept full of compressed air at a predetermined pressure. 35 schematically denotes a compressed air source which maintains the tank 34 at the desired pressure. The tank 34, which has an "energy shuttle" function, supplies pressurised air to one or more valves 33 through which the tank 34 can be placed in communication with the filtering elements 32. In the case in point, three valves 33 are illustrated, each of which is operatively associated with two filtering elements 32. The valves can be, for example, of the type having diaphragm obturators.

During normal filter 30 use, the obturators of the filter valves 33 remain in the closed position, preventing any communication between the tank 34 of the pressurised air and the filtering elements 32. The valves 33 are destined to be periodically opened, on command, with the aim of cleaning the filtering surfaces, to send compressed air from the tank 34 to the filtering surfaces themselves. Each diaphragm obturator is connected to an end of a respective pipe 36 kept under pressure. The opposite end of each pipe 36 is connected to a respective output connection functioning as a remote control for the periodic opening of the valves. This device, indicated in its entirety by 38, operates so as periodically to set the various pipes 36 in communication, one after another at determined intervals, with the outside environment at normal atmospheric pressure. This brings about a drop in pressure in the pipes 36 by effect of which the diaphragms in the valves 33 associated to the pipes 36 lift from their seatings, opening the connection between the tank 34 and the filtering elements 32 associated with the valves 33.

The control device 38 comprises the above-described pulse generator and an actuator 39 (illustrated in detail in FIGS. from 4 to 6) controlled by pressurised gas outputting from the pulse generator 1 and associated to at least one valve 33 by means of at least one pipe 36. In the illustrated example the control device 38 controls the opening of three valves 33, but it could just as well control a greater number. The control device 38 can also serve to control several filters 30.

The actuator 39 comprises a plurality of conduits 40, each of which has an end which can be sealedly coupled with an end of a respective pipe 36. The opposite end of each conduit 40 exhibits an orifice normally closed by an obturator 41; when an orifice is opened the conduit 40 and relative pipe 36 are placed in communication with normal atmospheric pressure, causing the opening of a valve 33 on the cleaning device.

The various obturators 41 are arranged circumferentially. The actuator 39 comprises a rotatable element 42, disc-shaped and mounted at the end of a rotatable shaft 43 whose rotation axis y—y is aligned with the centre of the circumference of the obturators 41. The shaft 43 is connected, at the opposite end to the end bearing the element 42, to a ratchet gear comprising a sawtooth gear wheel 44 solidly mounted on the shaft 43 and a ratchet preventing the shaft 43 from rotating in one direction. The shaft 43 is controlled in its rotation, rotating intermittently in one direction by a singleacting piston 45 having an alternating axial motion according to an axis z—z. The piston 45 is made solid at one end to a diaphragm separating an upper chamber 47 from a lower chamber 48, the lower chamber 48 being kept at atmospheric pressure. A pneumatic pulse coming from the generator 1 increases the pressure in the upper chamber 47 and determines a displacement of the piston 45 in a downwards direction. When the pulse stops, a return spring 49 returns the piston 45 upwards. A predetermined single-direction rotation of the shaft 43 (and therefore the element 42) corresponds to each down-return cycle of the piston 45. Thus the pressurised gas outputting from the pulse generator 1 commands an intermittent rotation of the element 42.

The rotatable element 42 bears an organ 50 which projects axially from a face of the element 42 and which is arranged in proximity of the periphery of the element 42 itself. The projecting organ 50, for example a roller, is destined during the rotation of the element 42 to interact with the obturators 41 in succession, one after another. The projecting organ 50 is made in such a way as to open an obturator 41, pushing it in a radial direction externalwise (with reference to the rotation axis y—y of the element 42), each time that it passes in from of said obturator 41 during the course of its rotation. Each obturator 41 can therefore be opened for a brief period at each rotation of the element 42 and the relative projecting organ 50. A return spring closes the obturator 41 after the projecting organ 50 has passed before it. The actuator 39 is preferably but not necessarily made in such a way that at each pressure pulse received from the generator 1 an obturator 41 is opened. In the case in point, where the actuator 39 exhibits fourteen obturators 41 angularly equidistanced, each single rotation of the rotatable element 42 is equal to one-fourteenth of a full revolution.

The functioning of the pulse generator 1 and the blower device 31 controlled by the generator 1 will now be described.

Figures 2A, 2B, 2C, 2D:
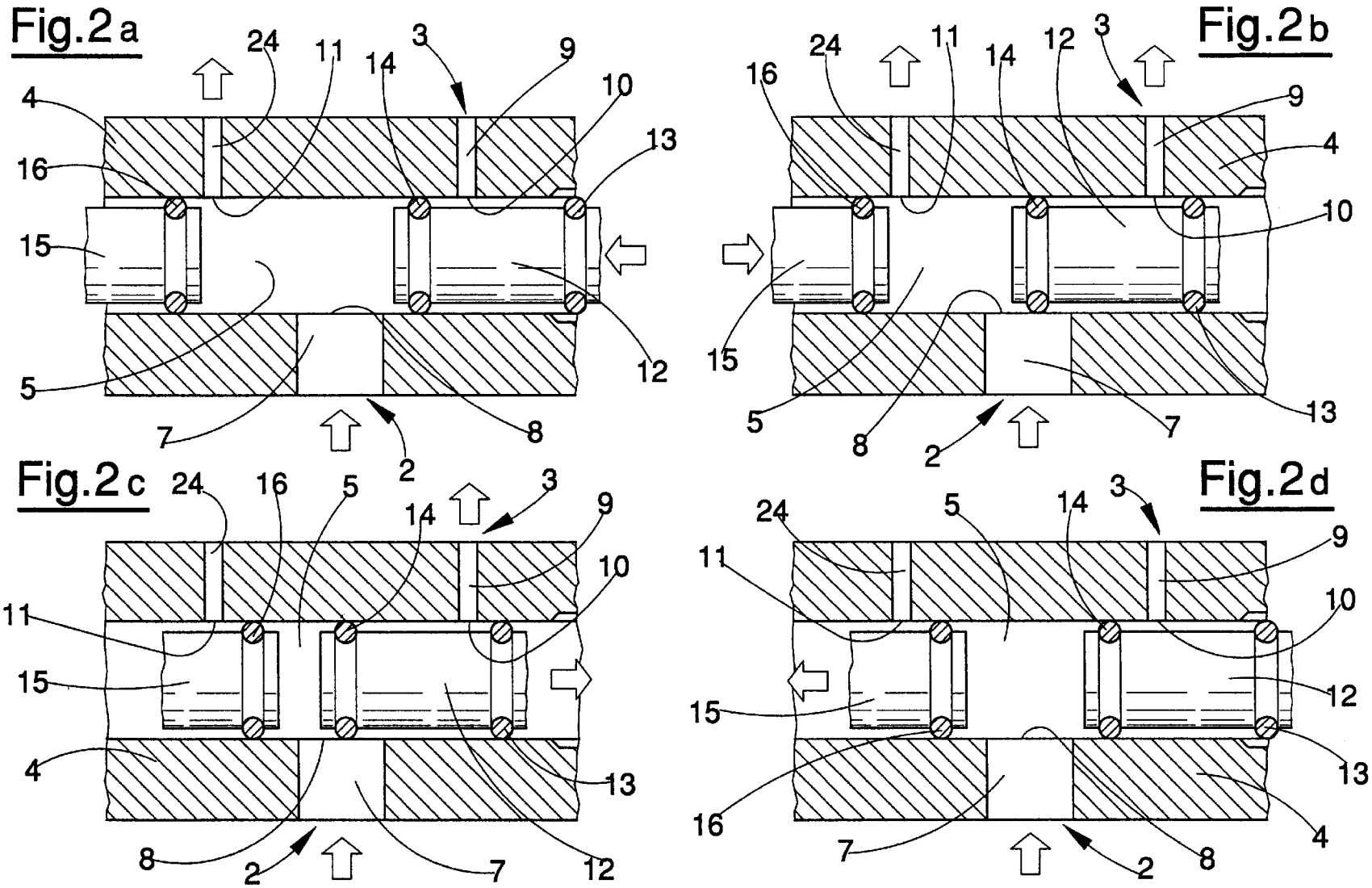
FIGS. 2*a* to 2*d* are schematic views of a detail of the pulse generator of FIG. 1 in various phases of the operative cycle.

The functioning of the generator 1 begins with the position illustrated in FIG. 2*a,* where both cursors 12 and 15 are in the first positions. The cursors 12 and 15 are pushed into these extreme positions due to the pressure of the supply at the input 2 of the generator. In this operative configuration the output 3 of the generator and the second chamber 26 communicate with a discharge 6, while the first chamber 23 communicates with the supply 2 of pressurised gas. The generator 1 is in a pause period between two pulses, during which the pressure at the output 3 is zero. The first chamber 23, in a predetermined and resettable time regulatable by means of the choke on the first conduit 24, reaches a pressure at which the first membrane 17 pushes FIG. 2*a*) the first cursor 12 leftwards, up until the situation of FIG. 2*b* is reached, in which the output 3 of the generator and the second chamber 26 are no longer connected to the discharge 6 but communicate with the input 2: during the passage from the configuration of FIG. 2*a* to that of FIG. 2*b* the generator 1 work cycle begins; during which period the pressure at the output 3 is more or less the same as that in input 2.

In the configuration of FIG. 2*b* the second chamber 26 is supplied with pressurised gas and, after a period of time which can be regulated by means of the second device 28, a regulatable choke, reaches a pressure by effect of which the second membrane 18 can press towards the second cursor 15. In the meantime the generator 1 continues to emit a pressure signal at the output 3. Thereafter the second cursor 15 reaches a position (see FIG. 2*c*) in which the third opening 11 is connected to a discharge 6, so that the pressure in the first chamber 23 rapidly drops, causing the first cursor 12 to move rightwards due to the pressure differential between the two opposite faces of the cursor 12 itself. This displacement, which happens brusquely once the third opening 11 is set in communication with the discharge 6, continues up until the situation represented in FIG. 2*d* occurs, in which the second opening 10 and thus the output 3 and the second chamber 26 connected with the second opening 1 are set in communication with a discharge 6. The outputting pressure signal from the generator 1 is thus reduced practically to zero. Furthermore the pressure in the second chamber 26 rapidly diminishes, with a consequent leftwards displacement of the second cursor 15, up until it returns to the situation shown in FIG. 2*a*. This displacement of the second cursor 15 occurs brusquely as soon as the second opening 10 is set in communication with the discharge 6. The calibrated choke 25 on the first conduit 24 enables regulation of the pause times between two consecutive pulses. In particular, by reducing the passage section of the first conduit 24, the pause time is increased. The first cursor 12 takes longer in its displacement from the first towards the second position; that is, in its displacement leftwards from the position of FIG. 2*a* to the position of FIG. 2*b*.

The calibrated choke 28 on the second conduit 27 means that the work time of each single pulse can be regulated. In particular, by reducing the passage second of the second conduit 27 the work time is increased. The second cursor 15 takes longer in its displacement from the first to the second position; that is, in its displacement rightwards from the position of FIG. 2*b* to the position of FIG. 2*c*.

As mentioned above, the displacements of both cursors 12 and 15 from the second to the first position (that is, the displacement of the first cursor 12 from the position of FIG. 2*c* to the position of 2*d,* and the displacement of the second cursor 15 from the position of FIG. 2*d* to the position of FIG. 2*a* occur brusquely, or in any case in a relatively short time which does not substantially depend on the size of the passage section regulated by the choke devices 25 and 28. This is possible by virtue of the fact that the devices 25 and 28 regulate the inputting low to the relative chambers 23 and 26, while the operate as fully open sections in relation to the flows in the opposite direction, that is, flows outputting from the abovementioned chambers 23 and 26.

The cleaning device 31 functioning is as follows. For each pressure pulse outputting from the generator 1 there is a determined rotation of the rotatable element 42. During the rotation the organ 50 interacts with at least one obturator 41 so as to open the orifice at the end of a conduit 40, which determines a drop in the pressure in the relative pipe 36 and thus the opening of a valve 33, with a consequent output of pressurised air to one or more filtering elements 32.

What is claimed:

1. A pneumatic pulse generator, comprising:

a distributor body having a chamber exhibiting at least a first opening connected to an input for a pressurised gas, at least a second opening connected to an output for the pressurised gas, and at least a third opening;

a first cursor, mobile internally of said chamber and able to assume at least a first position, in which said first cursor closes a connection between the first opening and the second opening and enables a connection between the second opening and a discharge, and a second position, in which the first cursor enables a connection between the first opening and the second opening and closes a connection between the second opening and the discharge; the first cursor being pushed towards the first position by effect of a pressure level at said input;

a second cursor, mobile internally of said chamber and able to assume at least a first position, in which said second cursor enables a connection between the first opening and the third opening and closes a connection between the third opening and a discharge, and a second position in which the second cursor closes a connection between the first opening and the third opening and enables a connection between the third opening and said discharge; the second cursor being pushed towards the first position by effect of a pressure level and said input;

a first compression chamber, connected through a first conduit to said third opening;

first means for regulating a flow of pressurised gas to the first compression chamber along said first conduit;

means for pushing the first cursor from the first to the second position by effect of a pressure in the first compression chamber;

a second compression chamber connected through a second conduit to said second opening;

second means for regulating a flow of pressurised gas from the second compression chamber along the second conduit;

means for pushing the second cursor from the first to the second position by effect of a pressure in the second compression chamber.

2. The pulse generator of claim 1, wherein said first means for regulating or said second means for regulating comprise at least one adjustable choke located on the first or second conduit.

3. The pulse generator of claim 1, wherein the first cursor exhibits two sealing organs, a first sealing organ having a function of sealing two zones of said chamber when the first cursor is in one of said two positions; a second sealing organ having a function of sealing two zones of said chamber when the first cursor is in another of the two positions.

4. The pulse generator of claim 1, wherein said first and second cursors are axially slidable in said chamber, are coaxial and each exhibit an end facing an end of the other cursor.

5. The pulse generator of claim 1, wherein said means for pushing the first or second cursors comprise a membrane which delimits said first or second compression chamber and which bears a rigid element destined to interact with the first or second cursor.

6. A blower device for cleaning dust filters, comprising:

a source of compressed air destined to act on a dust filter through at least one valve which valve during normal use is closed and which is destined to be periodically opened on command to send compressed air on to the filtering surfaces of said dust filter;

a control device for controlling the periodic opening of at least one said valve;

characterised in that said control device comprises a pulse generator, made according to any one of the preceding claims, and at least one actuator, controlled by pressurised gas issuing from a pulse generator and operatively associated to at least one said valve.

7. The device of claim 6, for controlling a plurality of said valves, wherein it comprises a plurality of conduits, each of which is associable to a respective valve and each of which is provided with an obturator which is normally closed, and on opening determines an opening of the valve associated to the conduit; said obturators being arranged circumferentially;

said actuator comprises a rotatable element, commanded to rotate intermittently by means of a pressurised gas issuing from the pulse generator, which actuator bears at least one organ destined during rotation to interact with the obturators in succession in such a way that each of said obturators is opened once for a brief time during each complete 360-degree rotation of the element.

8. The device of claim 7, wherein the actuator comprises a ratchet mechanism able to transform an up and down motion of a mobile element, actuated by the pressurised gas outputting from the generator, into a rotating intermittent movement of the rotatable element.

* * * * *